US010968095B2

(12) United States Patent
Wolff

(10) Patent No.: US 10,968,095 B2
(45) Date of Patent: Apr. 6, 2021

(54) CUSTOM BLENDING HOSE FOR MANIFOLD MIXING OF VARIOUS FUELS FOR FUEL DISPENSING SYSTEM

(71) Applicant: Brian P Wolff, Raytown, MO (US)

(72) Inventor: Brian P Wolff, Raytown, MO (US)

(73) Assignee: Husky Corporation, Pacific, MO (US)

( * ) Notice: Subject to any disclaimer, the term of this patent is extended or adjusted under 35 U.S.C. 154(b) by 0 days.

(21) Appl. No.: 15/731,932

(22) Filed: Aug. 24, 2017

(65) Prior Publication Data

US 2018/0057349 A1 Mar. 1, 2018

Related U.S. Application Data

(60) Provisional application No. 62/495,103, filed on Sep. 1, 2016.

(51) Int. Cl.

| | |
|---|---|
| ***B67D 7/74*** | (2010.01) |
| ***B67D 7/04*** | (2010.01) |
| ***B67D 7/42*** | (2010.01) |
| ***B67D 7/54*** | (2010.01) |

(52) U.S. Cl.

CPC ..... *B67D 7/741* (2013.01); *B67D 7/04* (2013.01); *B67D 7/0478* (2013.01); *B67D 7/42* (2013.01); *B67D 7/54* (2013.01)

(58) Field of Classification Search

None

See application file for complete search history.

(56) References Cited

U.S. PATENT DOCUMENTS

| | | | | |
|---|---|---|---|---|
| 2,984,388 | A * | 5/1961 | Scarr | B67D 7/742 222/71 |
| 5,042,537 | A * | 8/1991 | Grantham | B67D 7/0488 141/302 |
| 5,046,538 | A * | 9/1991 | Allison | B01F 5/08 141/105 |
| 5,285,826 | A * | 2/1994 | Sanders | B67D 7/54 138/114 |
| 6,019,146 | A * | 2/2000 | Taylor | B67D 7/16 141/100 |
| 6,223,788 | B1 * | 5/2001 | Taylor | B67D 7/16 141/104 |
| 2007/0193648 | A1 * | 8/2007 | Grantham | F02M 25/0836 141/59 |
| 2014/0318650 | A1 * | 10/2014 | Wolff | F16L 37/004 137/614.02 |
| 2017/0082224 | A1 * | 3/2017 | Larsson | B67D 7/04 |

* cited by examiner

*Primary Examiner* — Daphne M Barry
(74) *Attorney, Agent, or Firm* — Paul M. Denk

(57) ABSTRACT

A custom blending hose for manifold mixing of various fuels for a fuel dispensing system, including a pair of fuel dispensing hoses, generally concentrically or coaxially arranged, for passing at least a pair of fuels into a manifold assembly, for blending and intermixing of said fuels, for further delivery through a dispensing hose assembly, to a nozzle, for refueling of a vehicle. The manifold includes a housing, incorporating internally a series of apertures, through which the fuels are passed, and blended, for delivery as a uniform fuel to a vehicle during dispensing. A vapor return line may locate through the manifold.

4 Claims, 4 Drawing Sheets

CUSTOM BLENDING HOSE FOR MANIFOLD MIXING OF VARIOUS FUELS FOR FUEL DISPENSING SYSTEM

CROSS REFERENCE TO RELATED APPLICATIONS

This non-provisional patent application claims priority to the provisional patent application having Ser. No. 62/495,103, filed on Sep. 1, 2016.

FIELD OF THE INVENTION

This invention relates to the field of fuel dispensing, and more specifically pertains to a fuel dispenser wherein various blends or types of fuel can be intermixed within select percentage ranges within a fuel dispensing hose when delivered to a vehicle during refueling.

BACKGROUND OF THE INVENTION

This invention pertains to a device for dispensing of fuel, particularly fuels of different grades, types, or the like, wherein the intermixing can occur within a manifold within the fuel dispensing hose, just before it is delivered to its nozzle, for use in filling the fuel tank of a vehicle or other combustible fuel operating device.

As is well known in the art, and which has been available for many years, different grades of fuel, usually of various octane ratings, are readily available for dispensing at a service station. In addition, there are a few other grades and types of fuels that can be dispensed, whether it be diesel, ethanol, or the few other types of fuel that are currently being researched, such as from vegetation, or from many other sources. In addition, sometimes even aviation fuel may be a mixture of different blends, whether it be a combination of various octanes of gasoline, ethanol, and all for use for empowering a vehicle, such as an automobile, truck, or even an airplane. These are examples of the variety of uses that are currently being undertaken to the blending of fuels, in the art.

An example of a patent relating to this type of technology can be seen in U.S. Pat. No. 5,908,055, which shows a method and device for dispensing different types of fuel with a single fuel dispenser. It shows how fuel can be combined through to separate inlets, and dispensed from the same fuel hose.

The published application to Larsson, No. US2016/0083243, shows another fuel blending hose and fuel dispensing unit, wherein the separate fuel lines may be coaxial, delivering the combined fuel into an aligned or third fuel line, when delivering the fuel to its nozzle for dispensing. As can be noted, such a coaxial line may further include the usage of a vapor recovery line, to comply with the current standards for reducing vapor emissions, at the site of the nozzle delivery of fuel to a vehicle fuel tank.

Other patents that show devices for mixing and dispensing of two flowable materials can be seen in U.S. Pat. No. 6,105,822, to Larsen, et al., and it is upon a device and method for mixing and dispensing two flowable materials. U.S. Pat. No. 7,114,523, to Ricciardi, et al., shows an apparatus for mixing two fluids or keeping them separate. In addition, U.S. Pat. No. 6,926,030, also to Ricciardi, et al., shows a further apparatus for mixing two fluids or keeping them separate.

These are examples of the types of prior art that are thus available, relating to the blending of various fuels.

SUMMARY OF THE INVENTION

The invention relates generally to fuel dispensing, and more particularly contemplates the structural formation of a fuel blending device, locating within the fuel dispensing hose of a dispenser, and incorporating a manifold that assures thorough mixing and blending of various fuels, of different octanes, grades, types, before the fuel is dispensed from the nozzle into the fuel tank of any type of vehicle.

The fuel blending device of this invention can be located directly within and in alignment with the fuel dispensing hose, and be arranged in proximity either before, or after, the location of the current breakaway type of devices that are normally incorporated within the fuel dispensing hose of a dispensing system. In addition, such a fuel dispensing hose may also incorporate, in conjunction with the nozzle, a vapor return line, for drawing in vapors proximate to the location of the nozzle spout within the fill pipe of a fuel tank, and return these vapors back to the dispenser, for collection and storage, so that such pollutants do not enter into the ambient air, or atmosphere, and in compliance with various regulations.

The structure of the hose itself, of a first design, is of a standard fuel blending hose, of the concentric type, with an outer hose of a larger diameter than that of the inner hose. One fuel traverses in the outer hose, and another fuel passes through its inner hose, normally located coaxially within said outer hose.

The fuels are mixed together within a particularly styled blending manifold, wherein the fuels of different forms of grades become fully blended, and the combined fuels are delivered downstream, through the hose assembly, through the normally arranged swivel, and to the nozzle for dispensing. A second design of this blending feature is for use in conjunction with a vapor recovery fuel blending hose which is generally of the same design as the first described, but includes a vapor recovery line locating inside of the inner hose, as described. Once again, the fuels are mixed together at the blending manifold, with the dispenser vapor recovery structures located therethrough, and which can function routinely, for returning vapors back to the dispenser, while the blended fuel is being dispensed.

It is likely though, that the concept of this invention, a blending manifold, can also be utilized in a coaxial hose system.

It is, therefore, the principal object of this invention to provide the blending of various styles of fuel, delivered to a blending manifold, that assures the complete mixing of these various fuels together, before they are dispensed into the fuel tank of any vehicle.

Another object of this invention is to provide a uniform structure for the addition of a blending manifold, within a coaxial hose line, but assures the blending of fuel, without minimizing the flexibility of the fuel dispensing hose, as it is manipulated by the user when filling his/her vehicle fuel tank.

Another object of this invention is to provide a uniform structure for the addition of a blending manifold, within a concentric hose line, but assures the blending of fuel, without minimizing the flexibility of the fuel dispensing hose, as it is manipulated by the user when filling his/her vehicle fuel tank.

Still another object of this invention is to provide a uniquely styled manifold, for blending of various fuel together, at a predetermined mixture, when delivering such blended fuel to the vehicle being filled.

Yet another object of this invention is to provide a fuel blending manifold, within its system, that may locate before or after the breakaway coupling, normally associated with the fuel dispensing hose of a fuel dispensing system.

Yet another object of this invention is to provide a blending system for a fuel dispenser, that may blend various grades, different octane ratings, or even different styles and types of fuels, together, before they are delivered or dispensed to a vehicle during fill up.

Yet another object of this invention is to provide a blending fuel dispensing system that may be used in the blending of fuels for any type of vehicle, whether it be a automobile, truck, multi wheeler, or even tractors, diesel operated engines, trains, and even airplanes.

These and other objects may be come more apparent to those skilled in the art upon review of the summary of the invention as provided herein, and after undertaken a study of the description of its preferred embodiment, in view of the drawings.

DESCRIPTION OF THE PREFERRED EMBODIMENT

Figure 1:
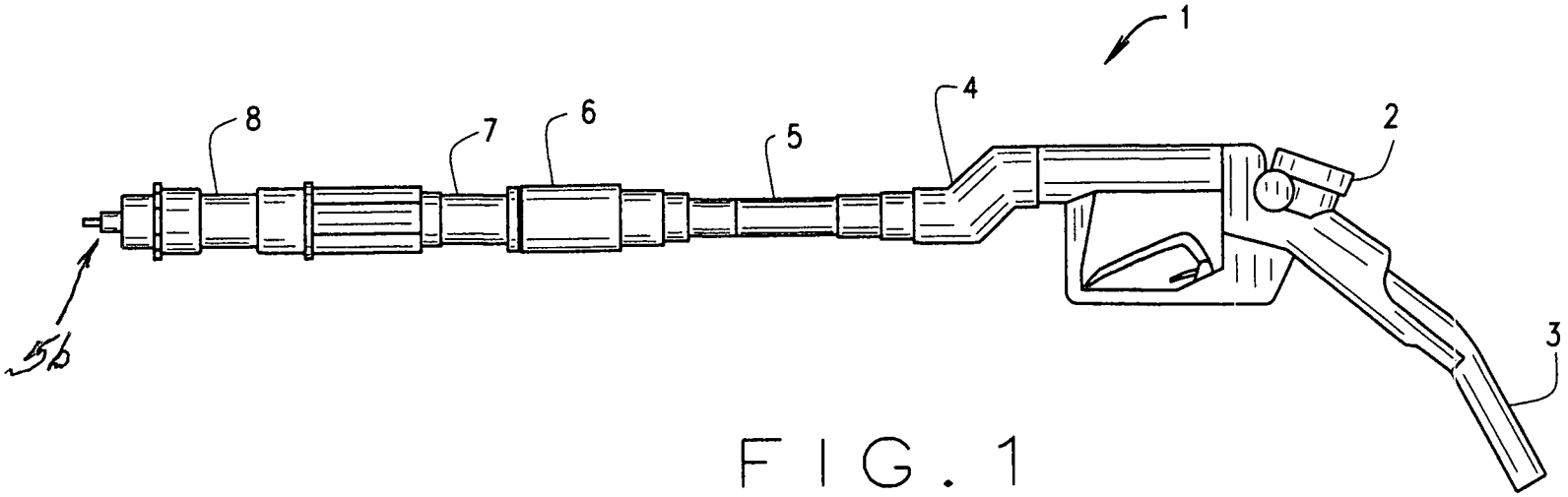
FIG. 1 provides a side view of the custom blending hose for manifold mixing of various fuels for a fuel dispensing system, showing the device installed within the fuel dispensing hose assembly, that connects with a multi plane swivel, and the fuel dispensing nozzle, of this invention; and used in a vapor return and capture system.

In referring to the drawings, and in particular FIG. 1, therein as shown the assembly 1 for dispensing fuel to a vehicle. It normally includes the nozzle 2, with its spout 3, that inserts into the fill pipe of the vehicle, during refueling. Connected to the back end of the nozzle is the multi plane swivel 4 which further connects with the hose assembly 5. The hose assembly, which may have greater length than shown in the figure, connects with the breakaway device 6, as known in the art. An adapter 7 connects with the breakaway and the blending hose assembly 8 is connected therewith. The blending hose assembly is shown at the upper end of the hose assembly, but it could be located at other positions within the dispensing hose, as can be understood. The blending hose assembly as noted, and which will be subsequently described, is of the type that may include a vapor return line, within its structure, in order to attract and collect the vapors at the tip end of the nozzle, during fueling, and convey the vapors back to the dispenser, and the underground fuel storage tank, as known in the art.

Figure 2:
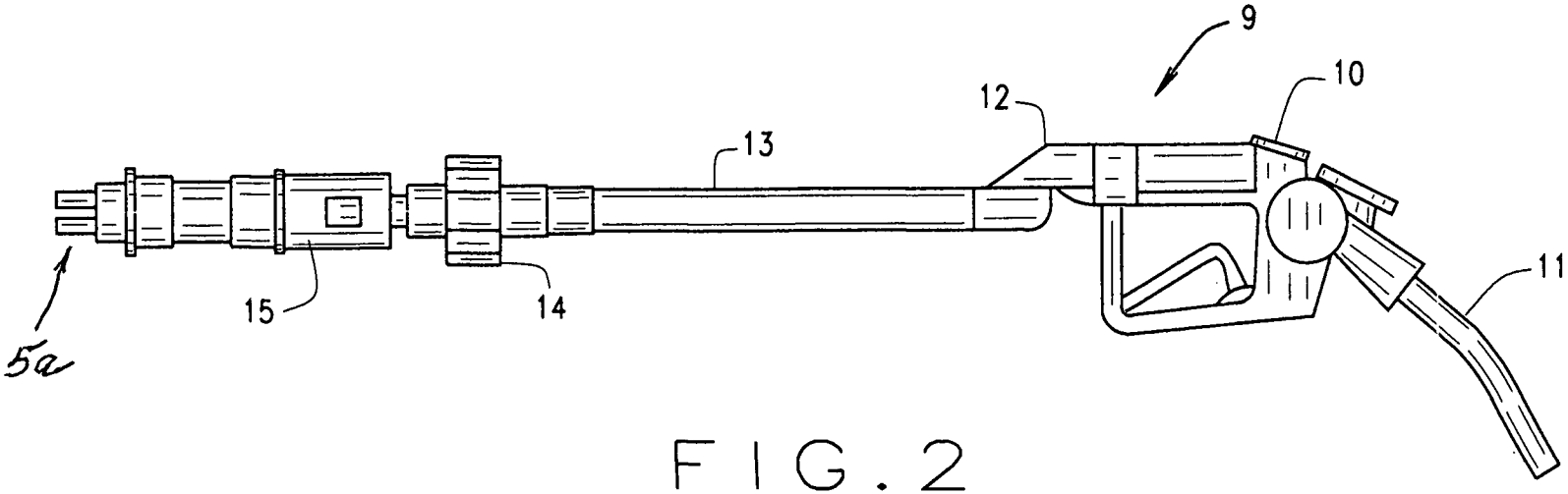
FIG. 2 shows a side view of the blending hose assembly, locating before the breakaway device, within the fuel dispensing hose, that connects with the multi plane swivel and dispensing nozzle of this invention.

FIG. 2 provides a side view of another fuel dispensing assembly 9 and it also includes its nozzle 10, the spout 11, connecting with their swivel 12, all of which connect with the hose assembly 13, which may have significant length to extend up towards the dispenser, but also has enough length of hose to allow the customer to locate the nozzle within the fill pipe of the vehicle, when refueling the same. The hose assembly connects with the breakaway device 14, and connected upstream from the breakaway device is the blending hose assembly 15, of this invention. This particular blending hose assembly is of the type that includes concentric hoses, incorporating the blending features of this invention, but without including the vapor recovery structure. Although the hose system could just as well be formed incorporating coaxial hoses in its structure.

Figure 3:
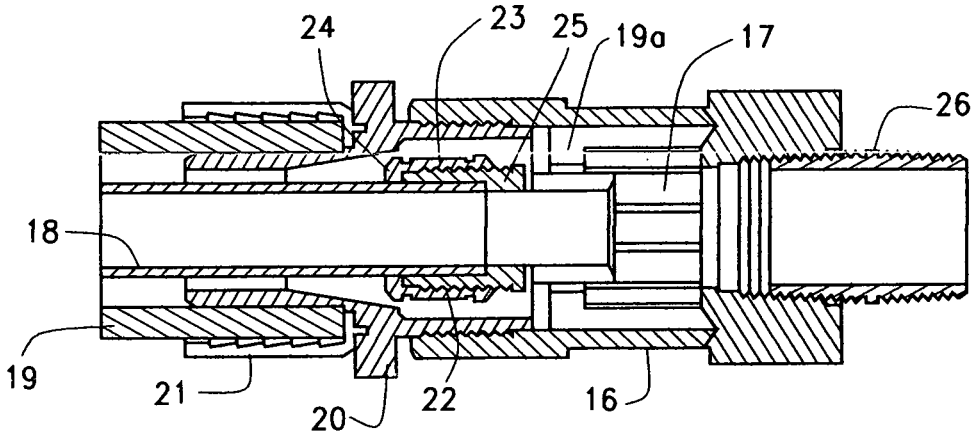
FIG. 3 is a longitudinal sectional view taken of the blending hose assembly, of the type incorporating concentric hoses, securing with the blending manifold of this invention.

As can be seen in FIG. 3, the blending hose assembly 15 includes an outer housing 16, which includes internally a manifold blending structure 17 of the type as shown, and as will be subsequently described, with regard to the FIG. 5. As shown, the hose assembly includes concentrically arranged tubes, including an inner tube 18 through which one of the blending fuels will flow, and has surrounding it the outer hose 19 through which a second fuel, to be blended, flows during dispensing. The outer hose 19 is compressed onto the stem 20, and secured into position by means of a ferrule 21 when securing the outer hose into position relative to the blending assembly. The inner tube 18 secures by means of a clip 22, and a compression nut 23 onto the compression tube fitting 24, for securement of the inner tube 18 to the compression fitting stem 25, as can be noted. The compression fitting stem 25 delivers its fuel into the manifold 17, where it is introduced to the fuel, of a different blend, passing through the outer dispensing hose 19, as previously reviewed.

It is within this manifold 17 that the combination of the fuels are intermixed together, for delivery, when combined, to the pipe nipple fitting 26, and eventually to its dispensing hose assembly 13, for delivery to the vehicle.

Figure 4:
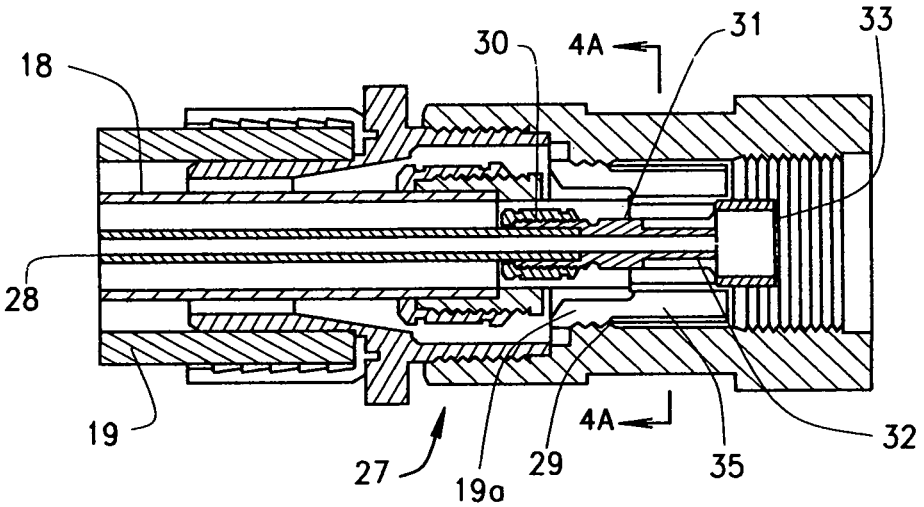
FIG. 4 shows a modification to the blending hose assembly, incorporating its concentric hose, and securing with its manifold, but further incorporating a vapor return line, centrally thereof, for returning fuel vapors back to the dispenser.

As can be noted in FIG. 4, this discloses the blending hose assembly 27, and of the type that also includes internally a vapor recovery tube 28. The vapor recovery tube 28, as can be noted, extends through the blending manifold 29, which is structured similarly to that as previously described with respect to the embodiment in FIG. 3, that is of the non vapor recovery type of assembly. As shown, the vapor recovery tube connects by means of a compression nut 30 to a stem fitting 31, which in turn includes at its downstream end a series of o-rings 32 for securement with a vapor coupler 33 which connects with the downstream vapor recovery tubing that extends through the hose assembly and onto the nozzle where vapor recovery occurs. Other than this difference, with respect to the vapor recovery aspects of this embodiment, of FIG. 4, the other components of the blending hose assembly are very similar in structure to the assembly as previously defines with regard to FIG. 3. Note that this particular blending hose assembly does not include a vapor return line. Obviously, this particular hose assembly is used in conjunction with the vapor recovery system of the fuel dispenser.

Figure 4A:
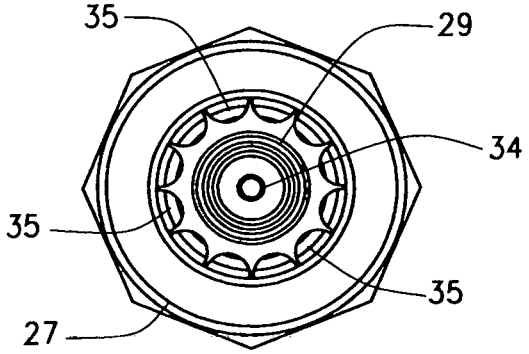
FIG. 4*a* is a sectional view taken along the line 4*a*-4*a* of FIG. 4.

As can be seen in FIG. 4*a*, this provides a sectional view through the housing 27, and disclosing internally its manifold 29, as previously reviewed.

Hence, when the two blends of fuel pass through the outer hose 19, and the inner tube 18, the fuels are blended together at the region of the manifold housing 27, and as they pass in combination through the manifold 29, as explained. As can be noted in said figure, the manifold does have the center aperture 34, that connects with the vapor tube 30, as noted. In addition, the manifold includes a series of apertures 35 through it, that allows the fuel to be intermixed as it flows through the manifold, and blended together for delivery to the vehicle, for refueling.

Figure 5:
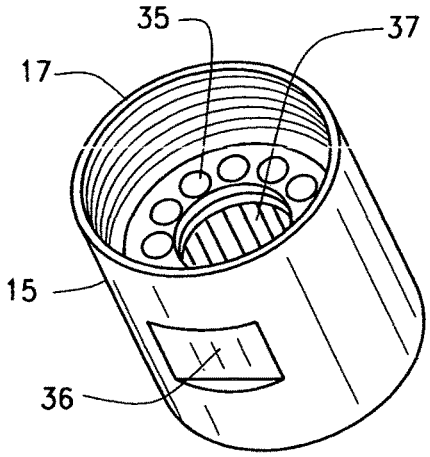
FIG. 5 shows an isometric view of the blending manifold of this invention.

As can be noted in FIG. 5, the blending manifold, as previously noted in FIG. 3 as structure 17, or in FIG. 4 as structure 29, includes its outer housing 15 and adds a series of lands 36 that allows for its threaded installation by a tool to the associated components, as described. Internally of the housing 15 is the manifold structure 17, or 29, and includes those series of apertures 35 that extend therethrough, and through which the fuel passes, to achieve blending, as can be noted. There is a further aperture as at 37 that contains the various couplers, as at 33, and which accommodates the location of the vapor recovery aspects of the development therethrough, as previously reviewed.

Figure 5A:
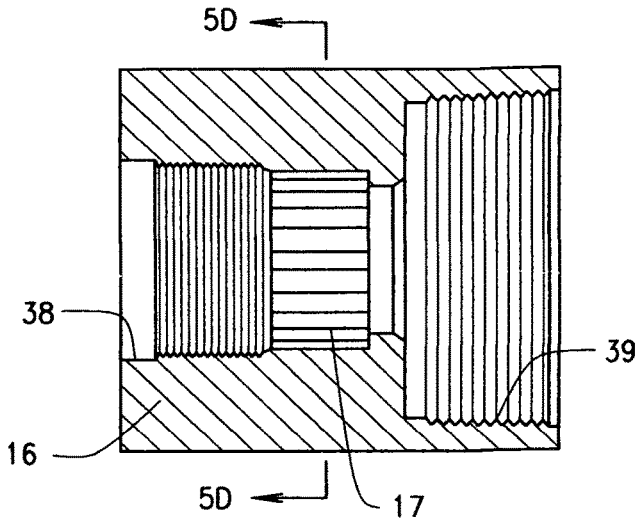
FIG. 5*a* provides a longitudinal sectional view of the manifold of FIG. 5.

FIG. 5*a* discloses the manifold housing 16, or 27, as previously explained. It includes the manifold 17, or 29, internally thereof. A counterbore, as at 38, includes a series of threads, as noted, for accommodating the locating of the vapor recovery assembly therein, and to allow for connection of the hose assembly, as previously described at 13 and 5, for threaded securement therein. On the upstream side of the housing 16, there is a further counterbore, as at 39, including a series of threads, that allow for the upstream side of the hose assembly to be engaged therewith, when the dispensing line is assembled for usage.

Figure 5B:
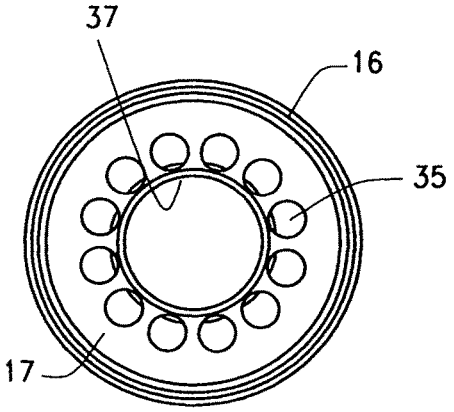
FIG. 5*b* is a right end view of the manifold of FIG. 5*a;*

As can be noted in FIG. 5*b*, the manifold assembly 17, or 29, includes the series of apertures 35 around its perimeter, and it is through these apertures that the deposited fuels are blended, as they pass therethrough. As can be realized, since the fuels encounter this manifold during its passage through the assembly, it encounters these restrictions, which may build up a slight additional pressure, move the fuels at a quicker velocity, which achieves a more instantaneous and effective blending of the fuels, for a further flow through the hose assembly, and for delivery to the nozzle for dispensing into the vehicle. These apertures 35 may be of any configuration, to achieve this result, or can be staggered in their radii dimensions from the center of the manifold, as can be understood, rather than being uniformly located around the perimeter of the manifold, as noted. As previously explained, the internal passage 37 of the manifold accommodates the vapor recovery aspects of the design.

Figure 5C:
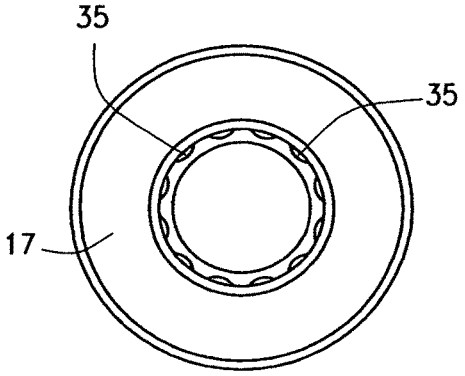
FIG. 5*c* is a left end view of the manifold of FIG. 5*a;*
Figure 5D:
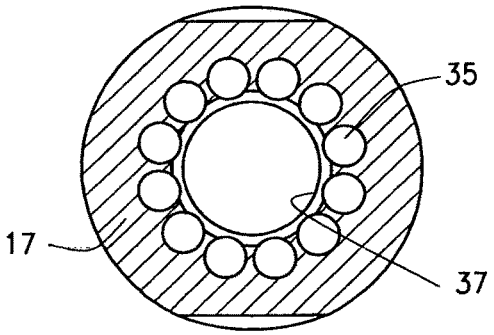
FIG. 5*d* is a cross-sectional view taken along the line 5*d*-5*d* of FIG. 5*a*.

FIG. 5*c* shows the downstream end of the manifold and its housing, noting the location of the flow through apertures 35 within its structure. FIG. 5*d* provides a sectional view taken along that line 5*d*-5*d* of FIG. 5*a*. As noted, the manifold, whether it be the manifold 17 or 29, has its center channel 37, and its series of peripheral apertures 35, that accommodates the blending aspects of this manifold, during its installation and operation within the dispensing hose structure of this invention.

Figure 6:
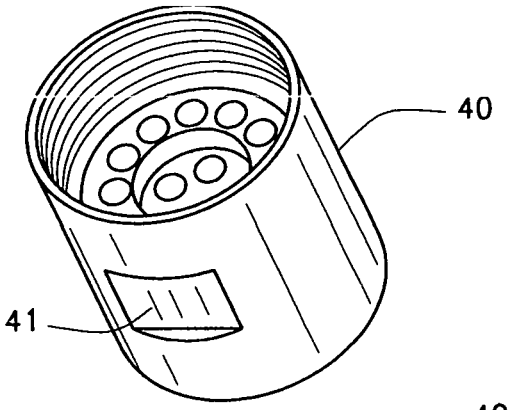
FIG. 6 shows an isometric view of a slightly modified blending manifold of this invention.
Figure 6A:
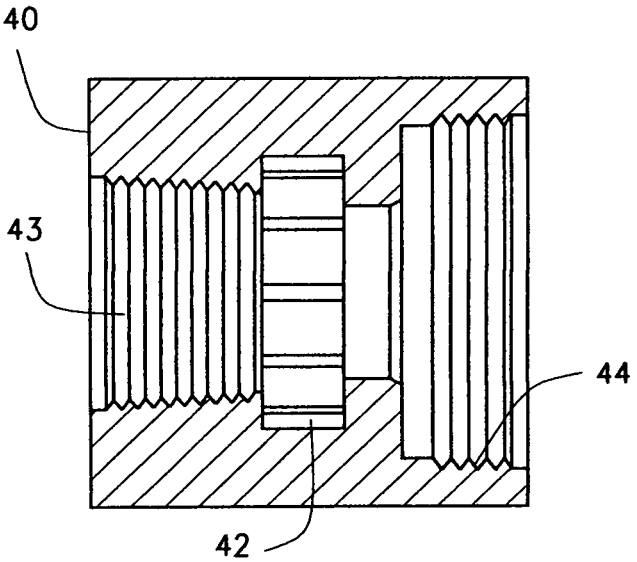
FIG. 6*a* provides a longitudinal sectional view of the manifold of FIG. 6.
Figure 6B:
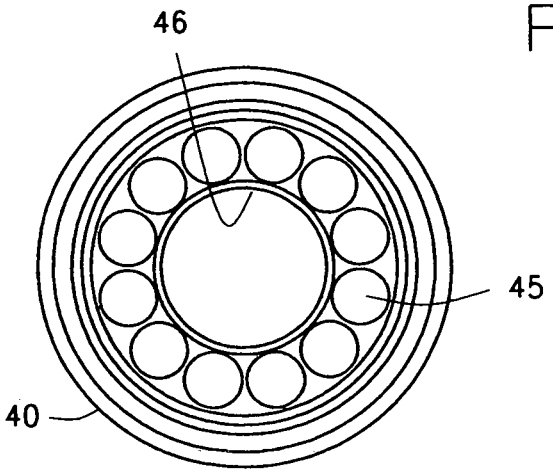
FIG. 6*b* is a right end view of the manifold of FIG. 6.

FIG. 6 provides a view of a slightly modified blending manifold 40, and as can be seen, it has at least a pair of lands 41 to cooperate with the tool for achieving its installation within the assembly. The manifold 42 can be seen, generally centrally arranged within the said manifold, having a threaded aperture, as at 43, to provide for its inner connection with the various tubings delivering the fuel to be blended to the assembly, and has a threaded opening 44 provided at its downstream side, to provide for the inner connection of the manifold to a pipe nipple fitting, of the type as shown in FIG. 3, and eventually for connecting with the dispensing hose assembly and to the nozzle, for delivery of the blended fuel. FIG. 6*b* shows the various apertures 45, of the manifold, and showing its central channel 46 through which the primary fuel passes, for eventual blending with the specialty fuel, as they pass through the manifold assembly.

The delivery of the various fuels to the blending hose of this invention through the use of coaxial arranged fuel lines can be seen at 5*a* in FIG. 2. The use of concentric fuel lines for delivery of various fuels for blending to the system can be seen at 5*b*, in FIG. 1.

The delivery of the various fuels to the blending hose of this invention through the use of coaxial arranged fuel lines can be seen at 5*a* in FIG. 2. The use of concentric fuel lines for delivery of various fuels for blending to the system can be seen at 5*b*, in FIG. 1.

Normally a fuel dispensing hose will pass a singular volume of fuel normally at a flow rate of 10 to 15, up to 60, more or less, gallons per minute. And, when it encounters the manifold assembly of this invention, where a number of fuels are to be blended, it encounters said manifold, which builds up a slight pressure in the range of 1 to 15 psi, speeds up its flow, and provides for thorough blending and mixing of the combined fuels, during their passage through the dispensing hose assembly of this invention. This provides for a thorough intermixing of these different blends of fuel, as previously summarized, to assure that the proper blended mix of fuels is achieved for dispensing into the vehicle, during refueling.

Variations or modifications to the subject matter of this invention may occur to those skilled in the art upon review of the disclosure as provided herein. Such variations if within the spirit of this invention, are intended to be encompassed within the scope of any claims issuing in a patent herein. The explanation of the invention within the preferred embodiment, and as depicted within the drawings, are primarily set forth for illustrative purposes only.

I claim:

1. A custom blending hose and manifold assembly for attaining a predetermined mixing of a first fuel and a second fuel for a fuel dispensing system for a vehicle, including a dispenser, nozzle and dispensing hoses, the custom blending hose and manifold assembly comprising:

said manifold assembly including a manifold structure provided within a manifold housing;

said dispensing hoses having an upstream end segment connecting with an entrance to said manifold assembly, and said upstream end segment of said dispensing hoses formed having either concentric or coaxial arranged fuel hoses for delivery of the first and second fuels to said manifold assembly for blending of the first and second fuels;

a unitary manifold structure formed of said manifold structure and said manifold housing, and formed for said manifold assembly, and free of moving components for mixing the first and second fuels together, said dispensing system including said unitary manifold structure provided in said manifold housing having an upstream end connecting with the upstream end segment of the dispensing hoses, with said dispensing hoses conveying separately the first and second fuels to the manifold assembly, with each of the first and second fuels being combined in a region before the manifold assembly and as the fuel passes through said manifold structure of the manifold housing, said manifold housing having a downstream end and connecting with a downstream end fuel dispensing hose for delivery of the blended fuels to the nozzle and dispensing into a fuel tank of said vehicle;

said custom blending hose and manifold assembly including said manifold housing having a series of internal threads within intake end of the manifold housing, for connection of the dispensing hoses, and said manifold housing having an internally threaded opening at an outlet end, for connection with a downstream end fuel dispensing hose;

said manifold structure including a series of apertures formed to allow passage of the first and second fuels for delivery to the manifold structure for mixing of the second fuel with the first fuel and the blended fuels to be delivered to the connected downstream end dispensing hose for delivery of the blended fuels to the nozzle and dispensing into the fuel tank of the vehicle;

said manifold housing includes an outer housing, and an integral internal said manifold structure includes said series of apertures being peripherally arranged within the manifold structure to allow for passage of the blended fuels at increased pressure and quicker velocity during intermixing when passing through said manifold assembly for delivery to the dispensing hose of the fuel dispensing system, said series of apertures being circularly arranged around the perimeter of said manifold structure;

a central aperture in the manifold structure for receiving an internal vapor recovery tube of a vapor recovery system of the fuel dispensing system; and wherein the manifold assembly can attain a blending of fuels of various grades, different octane ratings, and even different styles, and types of fuels together, as they enter the manifold structure of the assembly to deliver the blended fuel to the fuel tank of the vehicle.

2. The custom blending hose and manifold assembly of claim 1, wherein the internal vapor tube extends centrally through the manifold housing and is positioned within a central aperture in the manifold structure, to allow for the attraction and collection of vapors for delivery back to the dispenser to attain vapor recovery during use of the fuel dispensing system.

3. The custom blending hose and manifold assembly of claim 1, wherein said dispensing hoses are concentrically arranged in their connection with the upstream and of the manifold housing.

4. The custom blending hose and manifold assembly of claim 1, wherein said dispensing hoses are coaxial arranged for connection with the upstream end of the manifold housing.

* * * * *